United States Patent [19]

Rector

[11] Patent Number: 4,971,315

[45] Date of Patent: Nov. 20, 1990

[54] UNDER-DECK MOUNTED RETRACTABLE DIVING BOARD

[76] Inventor: Bob D. Rector, R.R. 1, Raccoon Lake, Rockville, Ind. 47872

[21] Appl. No.: 266,855

[22] Filed: Nov. 3, 1988

[51] Int. Cl.[5] ..... A63B 5/08; B63B 1/00

[52] U.S. Cl. ..... 272/66; 441/39; 114/61

[58] Field of Search ..... 272/66, 1 B, 65; 114/61, 362; 4/496; 414/537; 441/39

[56] References Cited

U.S. PATENT DOCUMENTS

| | | | |
|---|---|---|---|
| 1,126,087 | 1/1915 | Rohmer | 272/66 |
| 3,166,315 | 1/1965 | Jewett | 272/66 |
| 3,503,357 | 3/1970 | Ferris | 114/61 |
| 3,767,193 | 10/1973 | Johnson | 272/66 |
| 4,198,187 | 4/1980 | Mountz | 414/537 |
| 4,722,109 | 2/1988 | Mountz | 14/71.1 |

FOREIGN PATENT DOCUMENTS

| | | | |
|---|---|---|---|
| 0648237 | 2/1979 | U.S.S.R. | 272/65 |

*Primary Examiner*—Stephen R. Crow
*Attorney, Agent, or Firm*—H. John Barnett

[57] ABSTRACT

A retractable diving board which is mounted on the underside of a platform or deck, preferably in the front of a pontoon boat, so it may also serve as a gangplank. The under-deck mounting of the retractable diving board leaves the deck surface uncluttered and available for other uses, and is also safer for passengers. The retracted diving board can be locked for added safety when the pontoon boat is unattended.

3 Claims, 1 Drawing Sheet

UNDER-DECK MOUNTED RETRACTABLE DIVING BOARD

BACKGROUND OF THE INVENTION

1. Field of the Invention

This invention is directed to a retractable diving board which is mounted on the underside of a platform or deck, preferably the front deck of a pontoon boat, so it may also serve as a gangplank. In recent times, there has been a phenomenal increase in the number of man-made reservoirs and ponds made available for use as recreational facilities. The U.S. Army Corps of Engineers has created innumerable impoundments on the tributaries of every major United States navigable waterway for flood control. Large impoundments of water can now be found throughout all the Mississippi Basin, the Missouri, Cumberland and Tennessee, Santee-Cooper, Columbia, Potomac and many other river basins, extending even to the smallest of tributaries, not only to hold back water to prevent flooding of downstream population centers, but to provide water in drought periods to aid navigability and irrigation. The general policy has been to make these impoundments available for recreational use by the public. Swimming and diving and boating are the most popular uses for these bodies of water, and the manufacture and sale of pontoon boats for recreational use has grown because the shorelines of these flood control reservoirs fluctuate greatly, and it is difficult to provide permanent and stationary swimming and diving facilities. Private facilities are also controlled and limited. There is a greatly increased demand for recreational equipment, such as the pontoon boat, which is well suited for use on flood control reservoirs because it provides a stable and mobile platform from which to enjoy all the water sports now made available, including swimming and diving.

2. Description of the Prior Art

Diving has become a highly developed sport, and even an art form, as exemplified by the platform and three meter springboard diving competition of the Olympic Games. Many advances have been made in springboard construction and mounting over the years. For example, U.S. Pat. Nos. 3,862,755 and 4,049,263 show major advances in springboard construction from wood diving boards common forty to fifty years ago. The above patents describe an extruded metal, hollow core diving board and a specially constructed, fibre glass diving board, respectively. FIG. 1 of U.S. Pat. No. 4,049,263 shows the typical mounting of a diving board at water's edge with a fixed attachment at the inner end, and a movable fulcrum supporting the intermediate portion of the diving board. Spring characteristics are changed by moving the fulcrum forward towards the front end of the board to decrease flexibility and back towards the fixed attachment to increase flexibility.

Various auxiliary means have been proposed for enhancing the spring characteristics of shorter, stiffer springboards for use at home pools and locations where cost and space prevent the use of full-sized, conventionally mounted springboards. U.S. Pat. No. 3,804,405 describes a shorter, wooden board mounted on a specially designed spring base which is anchored at poolside.

U S. Pat. No. 3,767,193 is directed to a portable diving board which is telescopically mounted in a support frame which, in turn, is mounted on the top of a raft or other platform. This patent shows the diving board telescopically enclosed in a tubular member and mounted on the top surface of a raft by means of brackets. In order to clear the platform of the diving board, it is necessary to retract the board and detach it from the brackets and remove it from the area. The brackets are normally intended to remain, providing dangerous obstructions for an unwary person to trip over.

Mountz U.S. Pat. No. 4,722,109 describes a retractable ramp for trucks which includes parallel spaced rails extending longitudinally of the truck which are secured to the truck chassis. A ramp is movable longitudinally in the track formed by the rails. It does not appear from the description that Mountz intends the ramp to be supported by the channel members in use, because hooks are provided on the forward end of the ramp for insertion into the truck sill plate when the ramp is in use.

SUMMARY OF THE INVENTION

The subject invention is directed to a retractable diving board which is mounted on the underside of a deck or other platform, and which provides no obstruction to the upper surface of the deck or platform. The diving board is easily slid from its hidden, stored position under the deck or platform out to an extended position for use. When mounted on the underside of the front deck of a pontoon boat, the extended diving board also serves as a convenient and stable gangplank for passengers leaving or coming aboard the pontoon boat. The diving board is slidably received in a pair of parallel channel members which are secured to the underside of the deck or platform. The board has stop means attached to its underside to prevent overextension and removal of the board from the channel members. A transverse fulcrum extends across the bottom of the channel members at their outer ends to provide additional support for the diving board.

DETAILED DESCRIPTION OF THE INVENTION

Figure 1:
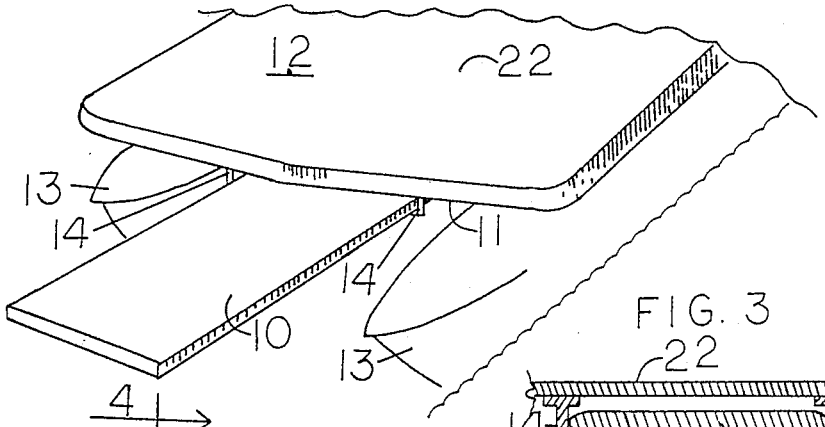
FIG. 1 is a perspective view of the front deck of a pontoon boat with parts broken away, and showing the retractable diving board of the invention extended outwardly from the underside of the front deck between the pontoons.
Figure 3:
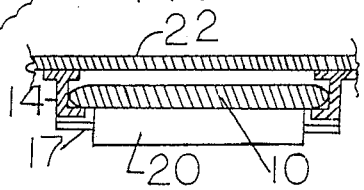
FIG. 3 is a transverse sectional view taken on lines 3—3 of FIG. 2 showing the retractable diving board slidably disposed in the attachment assembly which is secured to the underside of the front deck of the pontoon boat.

As shown in the drawings, a diving board 10 is slidably received and supported on the underside 11 of a front deck 12 between a pair of pontoons 13 of a pontoon boat. The diving board 10 is slidably secured to the underside 11 of the front deck 12 by means of a pair of longitudinally extending, parallel channel members 14, which are secured to the underside 11 of the front deck 12 by means of brackets 15 which are welded or bolted to transverse deck beams 16 which support and reinforce the deck 12.

Angle stop 17 is provided at the inner end 18 of the channel members 14 to prevent the diving board 10 from retracting too far under the front deck 12. A transverse support member 19 is secured to the front undersides of the channel members 14 to provide a fulcrum and additional support to the diving board 10 when it is in the extended position. A stop means 20 is provided at the inner end 21 of the diving board 10 to limit the extension of diving board 10 to that which will be stable and safe in use, both as a diving board and as a gangplank for loading and unloading the flat, front deck 12 of the pontoon boat.

Figure 5:
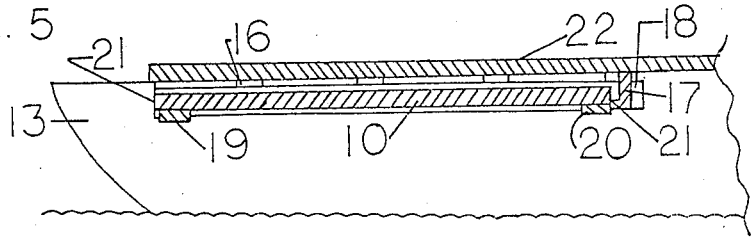
FIG. 5 is like FIG. 4, but showing the diving board in the retracted position under the front deck of the pontoon boat.

As best seen in FIG. 5, the diving board 10 may be completely retracted under the flat deck 11. In either position, there is no interference with the upper surface 22 of the flat, front deck 12 because the diving board 10 is mounted on the underside 11 of the deck 12.

Figure 2:
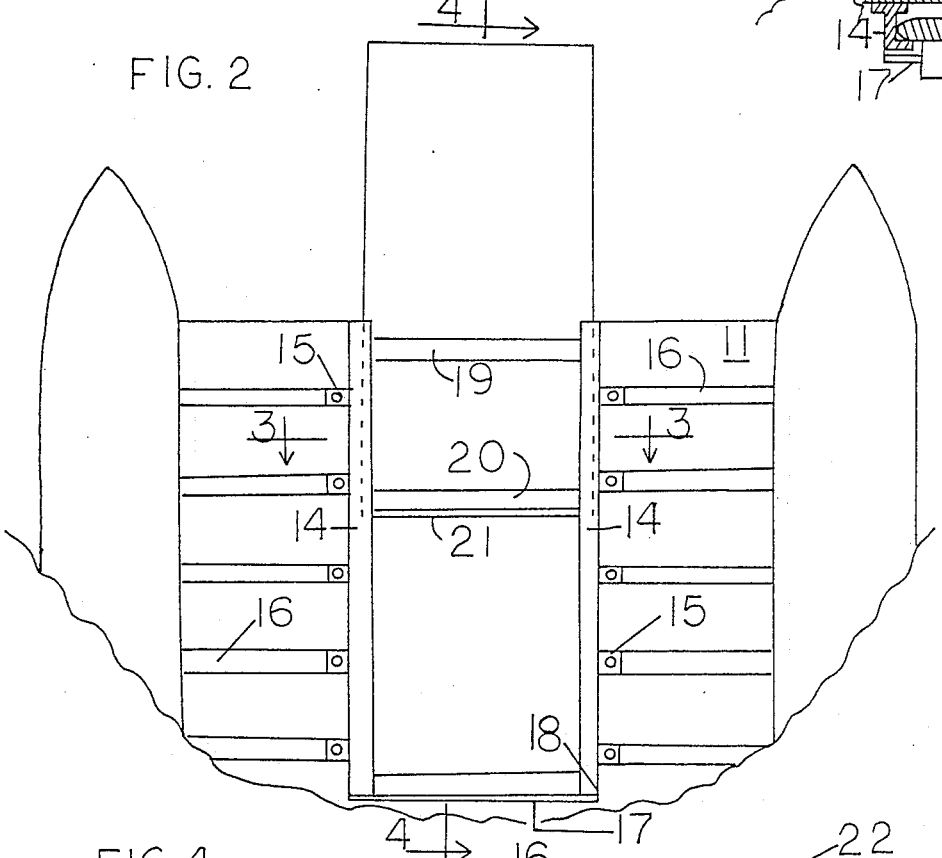
FIG. 2 is a plan view of the underside of the front deck of the pontoon boat with parts broken away, and showing the attachment assembly for the diving board, which is shown in the extended position.
Figure 4:
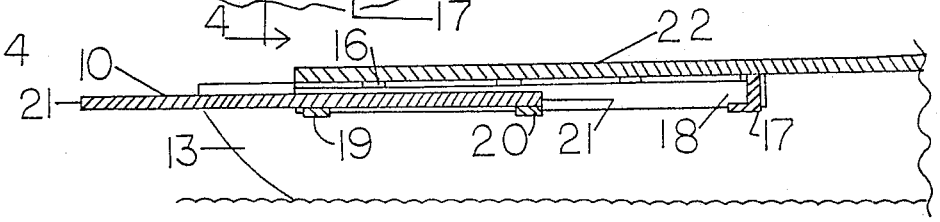
FIG. 4 is a longitudinal sectional view taken on lines 4—4 of FIG. 2 with parts broken away, and showing the retractable diving board in the extended position as in FIGS. 1 and 2.

FIGS. 1, 2 and 4 show the diving board 10 in the fully extended position. In this position, the diving board 10 is supported both by the channel members 14 and the transverse support member 19, which also serves as a fulcrum for the diving board 10. In addition, the placement of the diving board 10 between the forwardly extending pontoons 13, and parallel to their long axes, makes the diving board 10 useful as a gangplank for loading and unloading passengers. The midway location along the longitudinal central axis of the pontoon boat makes the board 10 very stable underfoot, even when unloading directly from the front when the pontoon boat is beached, because the front ends of the beached pontoons 13 provide excellent balanced support to the board 10. This is also true when the diving board 10 is used for diving. The position of the board 10 provides maximum stability in either use.

There are no deck obstructions on the front deck 12 of the pontoon boat, either when the board 10 is extended or retracted, which adds to the safety of passengers traversing the front deck 12 when the pontoon boat is in use, especially when underway, and the possibility of distraction is greater. The diving board 10 may be very simply placed in "storage" when not in use, by simply pushing it into the retracted, storage position under the front deck 12.

It is, of course, contemplated that the retractable diving board of the subject invention could be mounted on the underside of any recreational deck whether it be part of a floating assembly or at the side of a body of water. The advantage of a clean deck surface is obtained in any case, and the ease of storage of the assembly makes it possible to retract the diving board to prevent its unauthorized use. Locking means can be provided for added security.

What is claimed is:

1. An improved diving board for a pontoon boat, said diving board being mounted on the underside of the horizontal front deck surface of the pontoon boat midway between and parallel to a pair of parallel pontoons extending along the long axis of said boat, said diving board being slidably supported in a pair of horizontally disposed channel members attached to the underside of the front deck surface and including complementary stop means comprising a fulcrum member extending between the outer ends of said channel members on the underside thereof, and a stop member secured to the underside of the diving board at its inner end, and which contacts the fulcrum ember to stop further extension of said diving board at a predetermined position, so that the diving boards is longitudinally disposed, and parallel to, the pontoons, and slidably extendable forwardly from the front deck of said pontoon boat to provide a combination diving board and gangplank, and retractable under said front deck surface for secure storage when not in use.

2. The diving board of claim 1, including stop means extending transversely across the back ends of said channel members for stopping the inward movement of the diving board.

3. The retractable diving board of claim 1, including bracket means for securing said channel members to the underside of the horizontal deck surface.

* * * * *